United States Patent [19]

Hazelhurst

[11] 4,431,241

[45] Feb. 14, 1984

[54] MULTICONDUCTOR CABLE CONNECTOR WITH CAM ACTUATED CONTACT COVERS

[76] Inventor: Gerald D. Hazelhurst, 2567 Riata, Houston, Tex. 77043

[21] Appl. No.: 213,942

[22] Filed: Dec. 8, 1980

[51] Int. Cl.[3] ..... H01R 13/453

[52] U.S. Cl. ..... 339/43

[58] Field of Search ..... 339/43, 44 R, 44 M, 339/39, 47–49, 97 R

[56] References Cited

U.S. PATENT DOCUMENTS

| | | | |
|---|---|---|---|
| 2,669,702 | 2/1954 | Klostermann | 339/94 M |
| 3,428,936 | 2/1969 | Arnao, Jr. | 339/44 R |
| 4,070,078 | 1/1978 | Chrones | 339/44 R |
| 4,230,391 | 10/1980 | Keglewitsch | 339/97 R |
| 4,249,788 | 2/1981 | McNeel | 339/49 R |

FOREIGN PATENT DOCUMENTS

| | | | |
|---|---|---|---|
| 2059081 | 6/1971 | Fed. Rep. of Germany | 339/43 |
| 204827 | 10/1923 | United Kingdom | 339/39 |

*Primary Examiner*—Neil Abrams

*Attorney, Agent, or Firm*—Browning, Bushman, Zamecki & Anderson

[57] ABSTRACT

A multiconductor cable connector includes two identical longitudinally arranged box-like housings each having connector fittings at one end to pass a multiconductor cable into the housings. Each housing has male and female multiterminal connector openings on one face thereof, and spaced from one another. Protective covers are hinged to the housings and arranged to cover the connector openings. Springs in the hinges urge the covers to close over the connector openings. The covers are arranged to open in opposite directions. Cam surfaces are formed on facing end edges of the covers so that when the two housings are fitted perpendicularly together with respective spaces between covers facing one another and then a 90° twisting motion is applied to bring opposite ends of the housings together, the cam surfaces on the covers on one housing engage the side walls of the other housing to force the covers into an open position to permit the mating connector openings to face one another and be pressed together into mating contact.

22 Claims, 9 Drawing Figures

FIG. 1
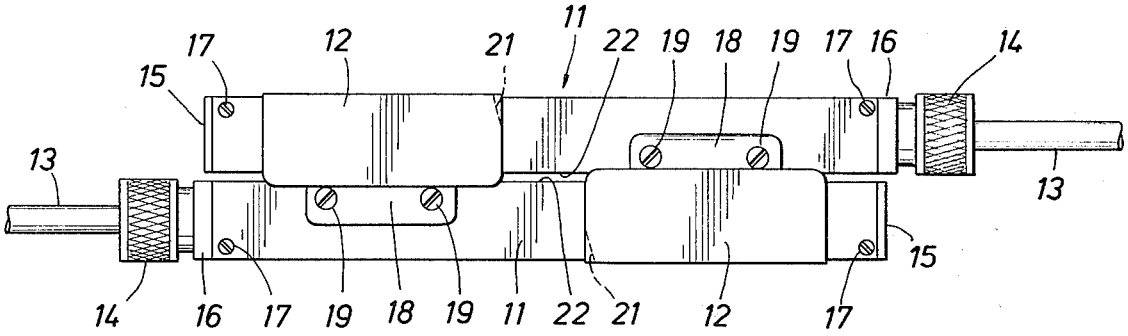
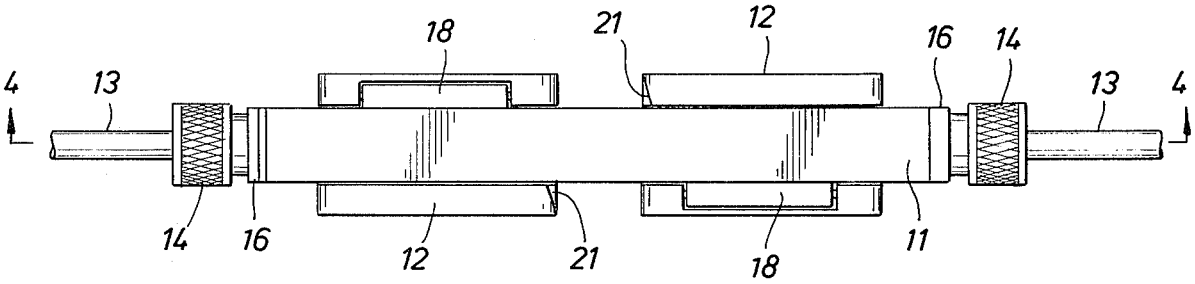
FIG. 2
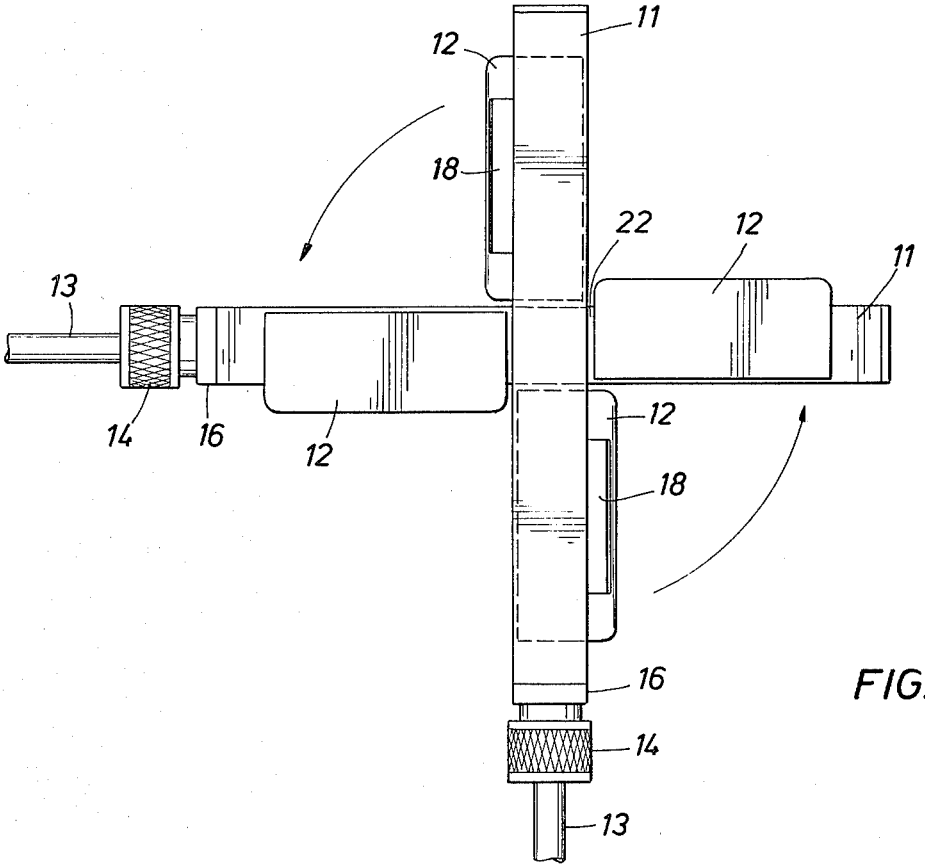
FIG. 3

FIG. 7
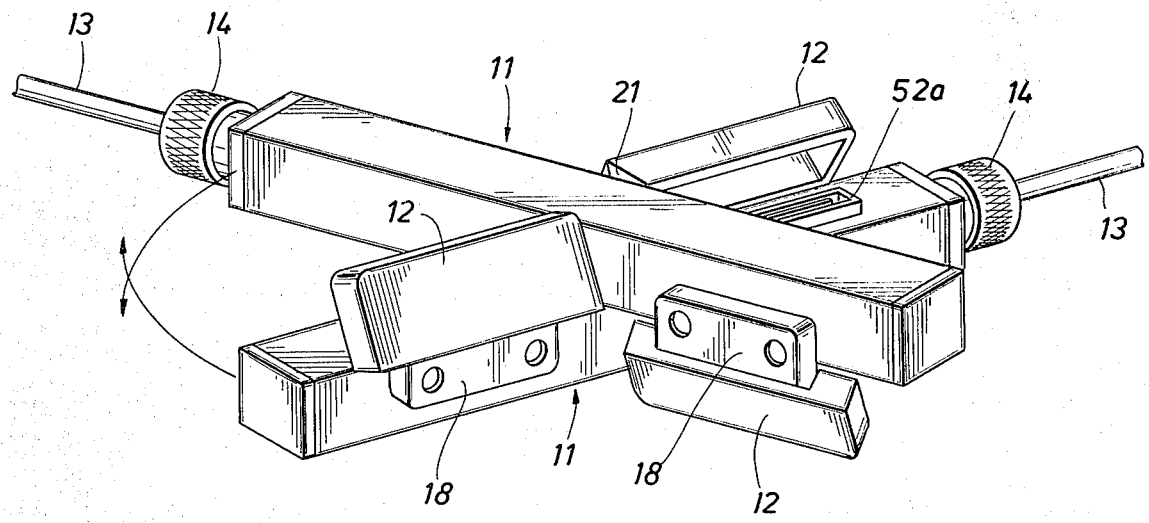
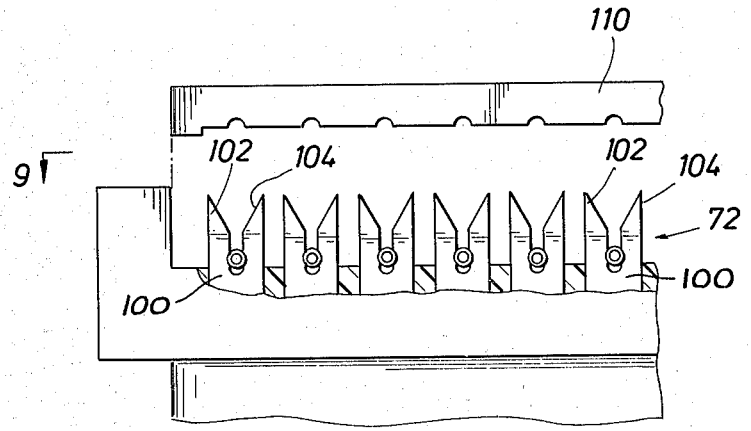
FIG. 8
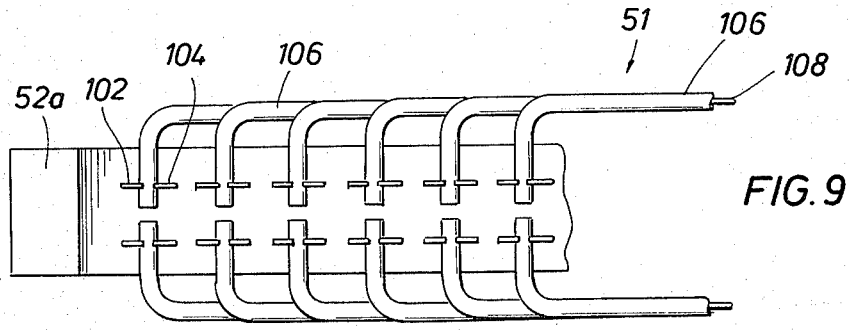
FIG. 9

MULTICONDUCTOR CABLE CONNECTOR WITH CAM ACTUATED CONTACT COVERS

BACKGROUND OF THE INVENTION

This invention relates to a connecting device for multiple wire electrical cables and, more particularly, to protected connecting devices for multiple conductor electrical cables used in seismic exploration.

Commonly in seismic exploration work, lengthy electrical cables having multiple conductors must be connected in end-to-end relationship to form a cable array. As the seismic work progresses, a particular multi-conductor cable section may be moved from one end of the cable array and attached to the opposite end of the cable array. This causes a walk-along effect of the cable section along the entire cable array. Each cable section at any given time can be located at any position along the length of the cable array, from the inner positions to the end positions.

Since the seismic exploration is generally conducted in remote regions and out of doors, it is highly desirable to provide protection to the individual cable connectors to maintain their electrical integrity. Therefore, in the prior art, cable connectors having covers over the electrical connecting pins or contact elements thereof have been proposed. Detachable or separable covers for the cable connecting pins become easily lost in the out of doors.

Cable connectors covers which require undue time to place upon or remove from the electrical connectors at the cable ends become a nuisance to operating personnel and are rapidly discarded for that reason. Even when such covers are attached to the cables to prevent loss, e.g. by chains or the like, workers often fail to use the covers and even have been known to cut the chains to permit the covers to be removed and discarded. This can lead to damage to the connecting pins of the cable, e.g. as it is moved through the outdoor terrain being surveyed.

Another problem associated with prior art seismic cables is that they have generally employed so called pin and socket contact type connectors in which the multiple wires or conductors were soldered or wrapped to the electrical contacts. There are two distinct disadvantages with such pin and socket type connectors: for one, the soldering or wire wrapping technique is more time consuming and reliable electrical connections are not always achieved. Additionally, the pin and socket type contacts are much more susceptible to bending and damage thereby reducing the mating cycle of such connection.

It is therefore an object of the present invention to provide a new and improved cable connector having a protective covering which is convenient to use and the use of which is integral with the operation of the connector.

It is also an object of the present invention to provide a seismic cable connector assembly which eliminates individual stripping, positioning and soldering of electrical conductors.

SUMMARY OF THE INVENTION

With this and other objects in view the present invention contemplates an electrical connector having a pair of housings each with male and female electrical contact groups. A male and female contact group are positioned on one face of each housing and are spaced apart to provide an open surface therebetween. A spring biased hinged cover member is provided for each contact group, and normally urges the cover member into a position covering its associated contact group. A cam surface is provided on each cover member and is arranged to cooperatively engage a portion of the other of the pair of housings to move the cover member to a position uncovering the contact group and thereby permit the contact group to be matingly coupled. Therefore when a pair of the housings are placed together at right angles with their open surfaces contacting and are subsequently twisted within the plane of the contacting surfaces into a parallel relationship, the cam surface on each cover member engages a body portion of the outer housing to lift the spring biased cover members out of their covering position over the contact groups. Thus the cover members are moved aside to permit, by a simple pushing action, the engagement of mating male and female contact groups on the respective housings.

The present invention also contemplates a seismic cable connector assembly comprising a first hollow body, a socket member mounted on said first hollow member, said socket body including a plurality of socket electrical contacts, each of said socket contacts being provided with an insulation stripping, solderless terminal, a second hollow body, a plug member mounted on said hollow body, said plug member including a plurality of plug electrical contacts matable with said socket electrical contacts in said socket member, each of said plug electrical contacts including an insulation-stripping solderless terminal, said plug member being receivable in said socket member.

BRIEF DESCRIPTION OF THE DRAWINGS

FIG. 1 is a side elevation view of a pair of cable connectors in accordance with the present invention showing the connectors with the protective covers raised in an engaged position;

FIG. 2 is a top view of the connectors of FIG. 1 and illustrating the cam surfaces on two of the covers;

FIG. 3 is a top view illustrating a pair of the cable connectors of the present invention placed at right angles prior to the connecting thereof;

FIG. 7 is a perspective view illustrating a pair of the cable connectors of the present invention as they are moved to cam open the protective covers prior to connecting of the cable connectors;

FIG. 8 is an enlarged view of the U-shaped insulation stripping solderless terminals in the pin carriers of the cable connector assembly of the present invention; and FIG. 9 is another, enlarged view of the solderless, insulation stripping terminals used in the pin carriers of the cable connector assembly of the present invention.

DESCRIPTION OF THE PREFERRED EMBODIMENTS

Figure 6:
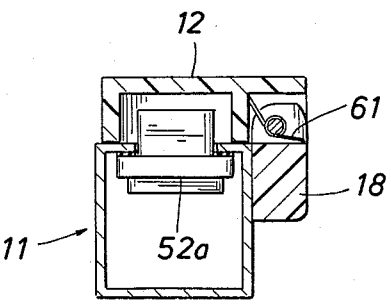
FIG. 6 is a transverse cross-sectional view of a single connector housing in accordance with the present invention and showing the protective cover portion thereof in the closed position.

Referring initially to FIG. 1, a pair of multiple conductor cable connectors in accordance with the present invention are shown connected to each other in a side elevational view. Each of the cable connectors is provided with an elongate hollow housing or body member 11 of a rectangular shape and having a generally square cross section (as illustrated in FIG. 6). The body member 11 has a length of approximately 6 to 8 inches. The body members 11 are provided on one end thereof opposite the entry end of a cable 13, with an end closure plate 15 which is secured by a set screw 17.

The multiple conductor electrical cable 13 is attached to the opposite end of each of the body members 11 by a strain relief connector 14, 16 which is secured to the body member 11 by a set screw 17. The cable strain relief connector 14, 41 will be described in more detail subsequently. Each body member 11 of the cable connector pair is provided with a pair of spring loaded protective cover members 12 located at opposite ends thereof and hinged to open in opposite directions. An open space 22 occurs between the spaced cover members.

Referring now to FIG. 6 it will be seen that the body member 11 has affixed thereto a cover baseplate 18 which is attached thereto by screws 19 (FIG. 1) and which carries pivotally or hinged mounted thereon a movable portion 12 of the protective covering. A spring 61 which bears resiliently on the cover base 18 and the movable protective cover member 12 establishes a spring bias so that the protective covering 12 is normally urged downwardly in FIG. 6 against the body member 11. In this position the hinged covering 12 covers an electrical contact support member or pin carrier **52*a* (FIG. 6) which is also attached to the body member 11 of each of the connector pairs of the present invention. Each connector half forming the pair of connectors is thus provided with a pair of protective covers 12 as illustrated more clearly in FIG. 2 and FIG. 3 which are affixed to opposite ends of the body member 11 leaving the open space 22 therebetween. Thus, the spring biased hinged protective covers 12 located near either end of the body members 11** open in opposite directions from each other.

It will be observed in FIG. 2 that each protective cover member 12 is provided at one of its peripheral corners with a slanted cam shaped surface 21 whose function will be described in more detail subsequently. It will be noted that the connector pair body members 11 are each symetrically provided with a pair of cable connector pin carriers **52*a* and 52*b* as illustrated in FIG. 6 in the sense that the pin carrier 52*b* at the one end of the housing 11 on each connector half may contain male pin members while the pin carrier 52*a* at the other end of the housing 11** may be provided with the opposite, or female, type pin connectors or vice versa. Thus, the outer connector on each housing is provided with the type connector (either male or female) suitable to engage its corresponding opposite member on the cable end of the housing.

Figure 4:
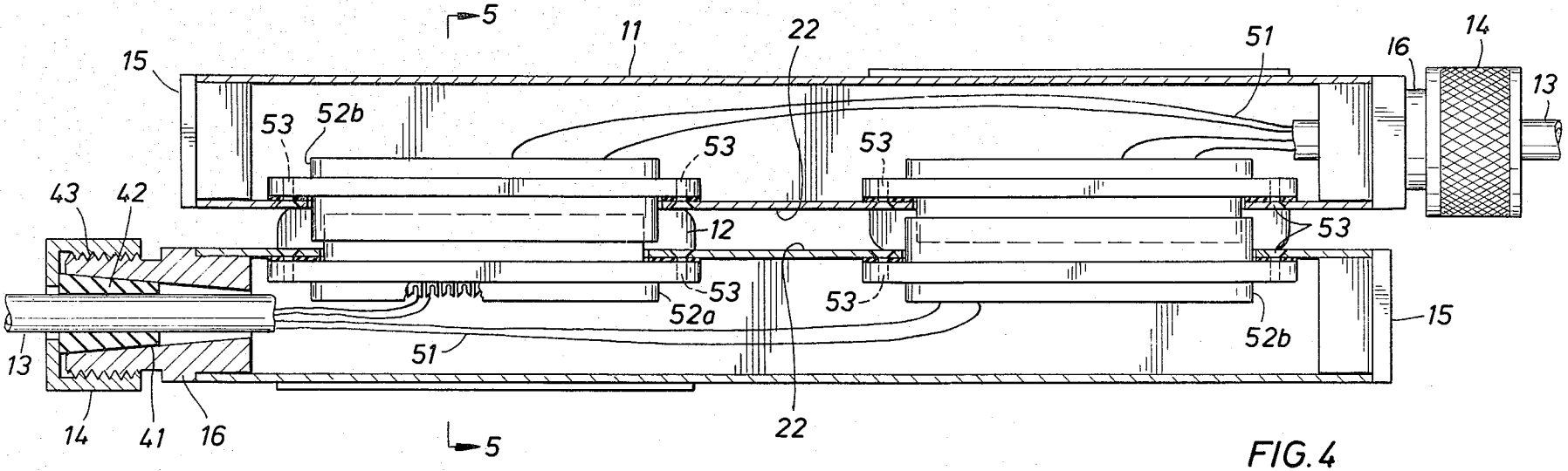
FIG. 4 is a partial sectional view taken longitudinally along line 4—4 of FIG. 2.
Figure 5:
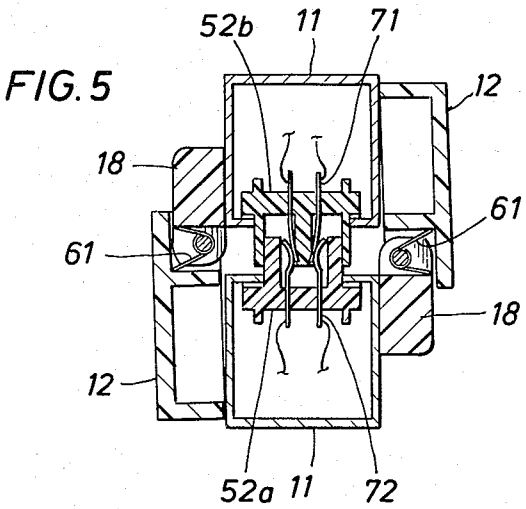
FIG. 5 is a cross-sectional view taken transversely along line 5—5 of FIG. 4.

Refering now to FIG. 4 and FIG. 5, the interior construction details of the connector of the present invention are shown in more detail. The pin carrier **52*a* and 52*b* is attached to the body member 11 via screws 53. Each pin carrier is provided with a plurality of self cleaning spring type contacts 71 and 72 as illustrated in FIG. 5. Individual electrical conductors 51 from the multiple conductor cable 13 are attached to the self cleaning spring type pin connectors 71, 72 by a method hereafter described. It will be observed from FIG. 5 that an outwardly spring biased male connector 71 carried by the pin carrier 52*b*, which is formed of an insulating material, is tapered inwardly to engage a cooperatively shaped female pin connector member 72 which is similarly mounted on pin carrier 52*a* in the opposite half of the connector pair. Thus with the protective cover members 12 raised in the position indicated in FIG. 5, the pin members 71 and 72 in each half of the connector pair may simply be shoved together into snug cooperative engagement. The motion of the male connector pin 71 into the female connector 72 provides a self cleaning action to the electrical contacts 71 and 72** of each member of the connector pair.

Referring to FIGS. 8 and 9, it can be seen that the pin carrier **52*a* and 52*b* which can be either a plug or a socket and the pin carrier connectors 72 or 71, include self stripping solderless terminals 100. Terminals 100 are generally U-shaped having first and second legs 102 and 104. Legs 102 and 104 are generally parallel, are deflectable away from one another and have insulation cutting edges facing one another such that when an electrical conductor 51 is forced between legs 102 and 104, the insulation 106 will be cut through exposing the wire 108, wire 108 then being in direct contact with legs 102 and 104. The compressive force within contact legs 102 and 104 ensures tight engagement between legs 102 and 104 with the wire 108 and eliminates the need for soldering the electrical conductors 51 to the pin connectors 71. As best seen with reference to FIG. 5, terminals 100 are disposed internally of hollow body 11. With reference to FIG. 8, it can be seen that the pin carrier 52*a* or 52*b* can be provided with a cover 110 which is snugly received on the underside of pin carrier which extends into hollow body 11 and which covers terminals 72**. A particularly desirable form of pin carrier is known as the Scotch Flex system marketed by the 3M Company.

Referring again to FIG. 4 the multi-conductor cable 13 is brought into the housing 11 of the connector via a cable strain relief system comprising an outer screw cap member 14 having an inner, inwardly tapered toroidal sleeve enclosure 42 which surrounds the jacket of the cable 13. A corresponding outwardly tapered bearing surface 41 on a cable closure member 16 is provided with cooperatively engaging threads 43 which engage the threads of outer screw cap member of the strain relief connector. Thus as the outer cap member 14 of the strain relief connector is tightened down, the wedging action provided by the cooperatively tapered surfaces 42 and 41 grips the outer jacket of the multi-conductor cable 13 at that point and relieves internal tensions on the multiple conductors 51 of the cable 13.

Conductor pairs 51 which are electrically connected to the individual spring biased contact members 71 and 72 are thus arranged so that the cable connector on one end of a section of a seismic cable array corresponds to conductor pairs attached to opposite (in the male and female sense) connectors. Thus the cable section is symetrically arranged so that it does not matter at what portion of the cable array a given cable section is located. The arrangement is such that continuity between corresponding conductors is maintained whether a given section of cable having multi-conductor connectors in accordance with the present invention is located either on the left or right end, or someplace between, of a composite seismic cable array made up of a plurality of such sections having connectors according to the present invention.

Referring now to FIGS. 3 and 7 one of the outstanding features of the present invention is illustrated with more particularity. In the illustration of FIG. 3 a pair of cables using the multi-conductor cable connectors of the present invention are shown placed at right angles to each other. When placed in this position, their open surface portions 22 between the protective covers are brought into touching engagement. If the pair of housings are then rotated in a counter-clockwise direction, as indicated by the counter-clockwise arrows of FIGS. 3 and 7 the camming surfaces 21 of the protective covering members 12 are brought into contact with the edge of the housing 11 of the other connector. The slanted camming surfaces 21 engage the opposite housing 11 and are thus utilized to force the covers 12 upwardly, (see FIG. 7) because of the pitch of the cam shape, against the bias of springs 61. Continued counter-clockwise rotation of the connector pair thus forces the cover members 12 into their fully open positions as illustrated in FIG. 5.

When counter-clockwise rotation through a full 90° of the housing 11 has been achieved, the protective cover members 12 are forced to their fully opened position and the corresponding male and female connector of each of the pair of multi-conductor cable connectors of the present invention are aligned. The connector may then be made up or connected by simply shoving the pair of housings 11 toward each other, thus engaging the multiple connector pins 71 and 72 corresponding to each of the cable conductors 51 as described previously.

In practice, therefore, it is seen that the multiple conductor cable connector of the present invention having multiple pin connections and provided with protective cover members over each set of pin connections may be made up or disconnected with great rapidity in field seismic operations. No chance is taken of losing the protective cover members. In making up or mating the connectors, a connector pair is simply placed at right angles at approximately mid points between the covers 12 and rotated through a 90° angle in a counter-clockwise direction. This action fully opens the spring biased protective covers and aligns the connecting pins of the electrical connectors for engagement. Engagement is then accomplished by simply drawing the connector pair together, completing the connection.

It will be noted that the arrangement of spring biased protective connector covers 12 causes pressure against the side of the opposite body member 11 of the connector pair when made up or connected and provides a rigidity to the connective structure. In this manner, the entire load of the connection is not sustained by the spring contacts of the individual cable conductors wires. Additionally, it will be noted that latching members (which are not illustrated in the drawings) could be provided on corresponding portions of the conductor pairs so that when the electrical connections are made the latches could be engaged to provide further mechanical integrity to the connectors. Simple latching members in the nature of a hook-shaped latch and eye could be provided for this purpose.

The foregoing description may make other alternative arrangements utilizing the concepts of the present invention apparent to those skilled in the art. Accordingly, it is the aim of the appended claims to cover all such changes and modifications which may be made within the true spirit and scope of the invention.

I claim:

1. A method of connecting a pair of elongated mating electrical connector housings each having a first side with a male and a female contact thereon, each such contact having an associated hinged cover plate biased into a contact covering position when said pair of connectors is unmated, comprising the steps of:

placing said elongated connector housings at substantially right angles to one another;

while at right angles, bringing said connector housings into proximate contact adjacent their first sides;

while holding such connector housings in proximate contact, rotating one housing about ninety degrees relative to the other housing in the plane of contact to bring said housings into substantially parallel mating arrangement;

while rotating said housings, contacting a camming surface of each of said cover plates with the other housing to move said cover plates to an open position exposing the associated contacts; and when said housings have been rotated into substantially parallel mating arrangement relative to one another pushing said housings together to bring said contacts into contacting engagement.

2. A multiple conductor electrical cable connector, comprising:

an elongate housing;

first and second electrical contact members on a first side of said housing and spaced longitudinally along the major axis of said housing;

first and second cover means hingedly connected to said housing so that in a closed position said cover means respectively cover said first and second electrical contact members; and first and second cam means located respectively on the sides of said first and second cover means which face toward each other, each cam means configured so that an elongate body placed between said cover means substantially in a plane parallel to that of said elongate housing and rotated in said plane toward said cam means to contact said cam means would simultaneously move said first and second cover means to a position uncovering said electrical contact members.

3. The cable connector of claim 2 further comprising first and second biasing means to maintain said hingedly connected cover means in a closed position protectively covering said electrical contact members when said cable connector is not in use.

4. The cable connector of claim 3 wherein said biasing means are spring biasing means.

5. The cable connector of claim 2 wherein said first and second cover means are located sufficiently far apart to permit the use of a second identical cable connector as said elongate body to cam open said cover means.

6. The cable connector of claim 2 wherein said firstelectrical contact member is a female member and said second electrical contact member is a male member.

7. The cable connector of claim 2 wherein said first side of said housing is substantially flat.

8. The cable connector of claim 2 wherein said elongate housing has a rectangular shape with parallel outer surfaces.

9. The cable connector of claim 2 further comprising cable means connected with said electrical contact members and means for providing entry of said cable means into the interior of said housing.

10. The cable connector of claim 9 further comprising strain relief means in said means for providing entry of said cable means into the interior of said housing.

11. The cable connector of claim 10 wherein said strain relief means through which said cable means passes comprises a toroidal cap member having an inwardly tapered bore and an end closure member having an outwardly tapered bore, said cap member and said closure member being adapted for threaded engagement with each other.

12. An electrical connector apparatus, comprising:

a pair of elongate housings each having a first surface for mating association with the first surface of the other housing and each housing including;

first and second electrical contact members on said first surface of each housing, spaced longitudinally along the major axis of each housing and spaced for mating engagement of said electrical contact members of one housing with those of the other so that said first electrical contact member of one housing is capable of matingly engaging the second electrical contact member of the other housing;

first and second cover means hingedly connected to each of said housings so that in a closed position said cover means respectively cover said first and second electrical contact members of each housing, said first and second cover means of each housing located sufficiently far apart to permit said housings to be placed at about right angles to one another with said first surfaces proximate one another and each of said first surfaces between said pair of cover means of the other of said housings; and first and second cam means located respectively on the sides which face toward each other of said first and second cover means of each housing, each cam means configured so that when a first housing is placed between said cover means of the other of said housings and substantially in a plane parallel to that of said other housing with said first surfaces proximate one another and is rotated in said plane, each of said housings will contact said cam means on said first and second cover means of the other of said housings and simultaneously move said first and second cover means to a position uncovering said first and second electrical contact members on each housing.

13. The connector apparatus of claim 12 wherein each housing further comprises first and second biasing means to maintain said hingedly connected cover means in a closed position protectively covering said contact members when said cable connector is not in use.

14. The connector apparatus of claim 13 wherein said biasing means are spring biasing means.

15. The connector apparatus of claim 12 wherein on each of said housings said first electrical contact member is a female member and said second electrical contact member is a male member.

16. The connector apparatus of claim 12 wherein said first side of each of said housings is substantially flat.

17. The connector apparatus of claim 12 further comprising on each housing cable means connected with said electrical contact members and means for providing entry of said cable means into the interior of each housing.

18. The connector apparatus of claim 17 further comprising on each housing strain relief means in said means for providing entry of said cable means into the interior of said housing.

19. The apparatus of claim 12 wherein when said housings are arranged at substantially right angles, the facing sides of said cover means of each housing are positioned substantially adjacent the longitudinal sides of the other of said housings.

20. The apparatus of claim 19 wherein said cam means is formed on said facing sides of said cover means and distal from the hinge sides of said cover means.

21. The apparatus of claim 20 wherein rotation of said housings in the plane of said proximate first surfaces from a position substantially at right angles to a position substantially parallel moves said cam means against the sides of the other of said housings and moves said cover means to a position uncovering said contact means.

22. The apparatus of claim 15 wherein said respective cover means associated with each of said male and female contact members on each of said housings open about their hinged connections in opposite directions.

* * * * *